United States Patent [19]

Roth et al.

[11] 4,198,820

[45] Apr. 22, 1980

[54] PUMPING UNIT FOR A WELL PUMP

[75] Inventors: Albert B. Roth, Lafayette; Wallace L. Thacher, Oakland, both of Calif.

[73] Assignee: N L Industries, Inc., Hightstown, N.J.

[21] Appl. No.: 935,552

[22] Filed: Aug. 21, 1978

[51] Int. Cl.[2] ..... F15B 15/18

[52] U.S. Cl. ..... 60/369; 60/372; 60/387; 91/275

[58] Field of Search ..... 60/369, 372, 376, 383, 60/384, 387, 415, 418, DIG. 2; 91/275, 304

[56] References Cited

U.S. PATENT DOCUMENTS

| | | | |
|---|---|---|---|
| 2,613,703 | 10/1932 | Calvert | 60/387 X |
| 3,916,768 | 11/1975 | Martin | 60/369 X |

*Primary Examiner*—Edgar W. Geoghegan
*Attorney, Agent, or Firm*—Lothrop & West

[57] ABSTRACT

A pumping unit for a well pump has a surface main cylinder with a main piston reciprocable therein, the piston having a connection to a standard well pump. In a flow cylinder of a relatively large diameter, a flow piston reciprocates within and divides the flow cylinder into a first flow chamber and a second flow chamber. The first flow chamber is in communication with the main cylinder. Air under pressure substantially to counterbalance the load on the well pump connection is supplied to the second flow chamber. There is a drive cylinder divided into a first drive chamber and a second drive chamber by a drive piston connected to but substantially smaller in diameter than the flow piston. A source of liquid under relatively high pressure and a sink for liquid under relatively low pressure are joined through a reversing valve to the opposite ends of the drive cylinder through ducts controlled by a reversing valve connecting the opposite drive chambers alternately between the pressure source and the pressure sink. In one of the ducts is a throttling valve movable between a restricted flow position and an unrestricted flow position, the valve being moved in response to the position of the drive piston. The combination provides an automatically operating, hydraulically actuated and air balanced intensifier actuating device for a well pump.

6 Claims, 3 Drawing Figures

PUMPING UNIT FOR A WELL PUMP

BRIEF SUMMARY OF THE INVENTION

A hydraulically driven, partially pneumatically counter-balanced intensifier is interposed between a hydraulic pump and a well pump in order to conserve on pumping energy and the necessity for transferring large amounts of hydraulic fluid throughout the system. A main pump is impelled through the intensifier by a drive cylinder under control of a reversing valve actuated by the drive cylinder piston and regulated by a throttling valve also controlled by the drive piston, the stroke of the drive cylinder being adjustable or variable and there being appropriate mechanisms for controlling acceleration of the drive piston near the ends of its stroke.

DETAILED DESCRIPTION

From time to time it becomes economically feasible and desirable to operate pumps in petroleum wells. Many of these require vertical mechanical reciprocation to make the pump function. There are many different devices for doing this. One is shown in the application of Albert B. Roth, an inventor herein, and Albert Louie entitled "Pumping Jack," filed July 7, 1978 with Ser. No. 923,028, and assigned to the assignee hereof. In that application there is disclosed a pumping jack having its main cylinder disposed horizontally on a base and connected by a cable and pulley multiplier to the polish rod of a downhole pump. The main cylinder piston is operated hydraulically by fluid derived from a pump operated electrically or by other comparable prime mover. The size and work of the equipment are such that the amount of hydraulic liquid necessarily transferred through the mechanism is relatively large and consumes a large amount of energy.

While the operation of the device identified is entirely satisfactory, there is a distinct advantage in reducing the amount of energy consumed. That is done herein by utilizing an intensifier to reduce the volume of working liquid that must be transferred through the mechanism. Reference is made to the mentioned application for disclosure of apparatus which is common to the two structures and may not be detailed herein.

Figure 1:
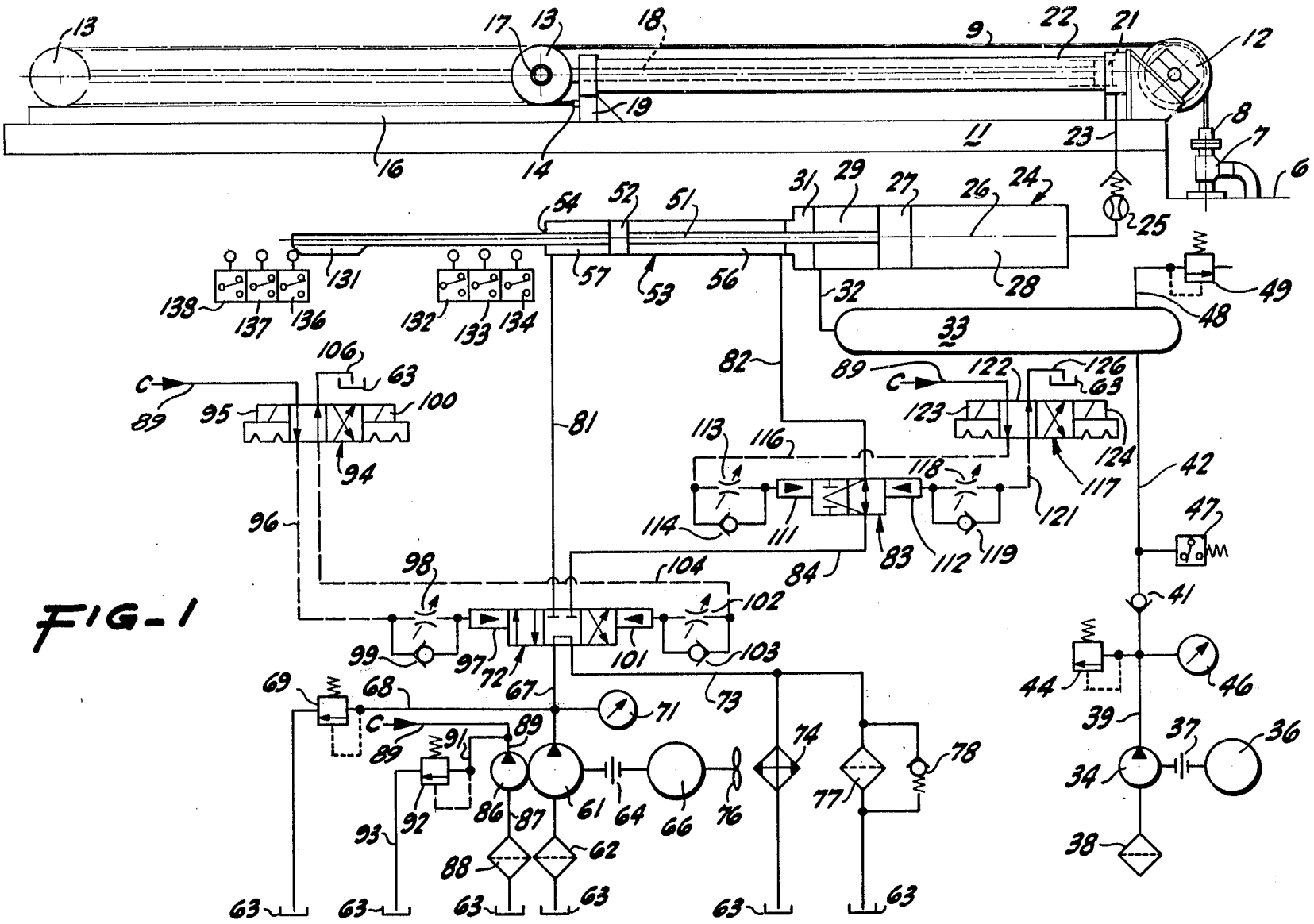
FIG. 1 is a schematic showing partially in diagrammatic form of a pumping unit for a well pump constructed pursuant to the invention.

As shown in FIG. 1, the ground 6 has a well 7 with a polish rod 8 connected to a cable or line 9. Adjacent the well on a suitable base 11 is a sheave 12 journalled to rotate about a transverse axis and carrying the line 9 also reeved around a travelling pulley 13 and then connected to an anchor 14 on the base 11. The pulley 13 is guided vertically and laterally on a longitudinal support 16 forming part of or secured to the base 11 and traverses or reciprocates between the solid line position shown in the figure and the dotted line position shown therein.

The pulley 13 is on a cross shaft 17 at one end of a main piston rod 18 operable through a cylinder head and bracket 19 upstanding from the base 11. The rod 18 is connected to a piston 21 reciprocable within a main cylinder 22 having a length slightly more than one-half the stroke of the polish rod 8, there being a two-to-one stroke multiplication by reason of the interposition of the pulley 13.

The mechanism just described is found in greater detail in the mentioned copending application, the present application being especially concerned with the hydraulic circuitry connected to the cylinder 22.

Connected to the main cylinder 22 through a conduit 23 is a flow cylinder 24. Under some extraordinary conditions, such as breakage of the polish rod 8, for example, there may be excessive flow in one direction through the conduit 23. For that reason, there is provided in the conduit 23 between the flow cylinder 24 and the main cylinder 22 a velocity fuse or check valve 25. This has the ability to preclude flow from the cylinder 24 to the cylinder 22 when such flow is in excess of a desired amount.

The flow cylinder 24 is of a predetermined, relatively large diameter and preferably extends with its axis 26 horizontally and preferably parallel to the cylinder 22, usually being mounted on the same base 11. Within the flow cylinder 24 a flow piston 27 is reciprocable between two variable or selective extreme positions. The piston 27 effectively divides the flow cylinder 24 into a first flow chamber 28 open to the conduit 23 and a second flow chamber 29. The chamber 29 is at one end closed by an intermediate cylinder head 31.

The second flow chamber 29 is designed to receive air under pressure. A connector 32 extends therefrom to an air reservoir 33 or pressure vessel having a suitable make-up air supply thereto. Included in such supply is an air pump 34 driven by a motor 36 through a coupling 37 and taking in atmospheric air through an air filter 38. Flow from the pump is through a duct 39 extending through a check valve 41 and a second duct 42 to one end of the chamber 33. The line 39 has a pressure relief valve 44 for maintaining the pressure below a maximum limit, the pressure being indicated by a gauge 46.

Connected to the line 42 is a pressure switch 47 effective to disable the motor 36 at a given maximum pressure and to enable the motor at a given minimum pressure. The motor 36 operates intermittently and the pump 34 maintains a general average pressure or a pressure between range limits within the reservoir 33. Connected to the reservoir also through a pipe 48 is a maximum pressure relief valve 49, so that no excessive pressure can be contained in the tank 33 or its connected system. In this way, a selected or predetermined pressure or pressure range is maintained in the chamber 29.

Extending through the intermediate head 31 is a piston rod 51 at one end joined to the flow piston 27 and at the other end having a drive piston 52 thereon. The drive piston reciprocates within a drive cylinder 53, preferably attached to and extending axially from the head 31. The drive cylinder also has a packing head 54 through which an extension of the rod 51 projects into the atmosphere. The piston 52 divides the drive cylinder into a first drive chamber 56 and a second drive chamber 57, both chambers being of the same diameter, and the diameter thereof being substantially less than the predetermined diameter of the flow cylinder 24.

In practice, the area or net available space subject to pressure within the drive cylinder 53 may be only about a third or a quarter of the effective area within the cylinder 24. Since the volume of the drive cylinder is thus much less than the volume of the flow cylinder 24, even though their stroke is the same, the volumetric displacement of the drive cylinder is only a fraction of that of the flow cylinder and a fraction of that of the main cylinder 22. Pumping and energy losses are therefore substantially less than in a customary system.

The drive piston 52 is impelled in opposite directions hydraulically. A main hydraulic pump 61 is connected through a screen 62 to a hydraulic reservoir 63 and is driven through a coupling 64 by an electric motor 66 or other suitable prime mover. The main pump 61 has a discharge line 67 from which a branch 68 goes through a pressure relief valve 69 back to the reservoir 63 and also is provided with a pressure gauge 71.

The discharge or pressure line 67 from the pump 61 continues to a main valve 72. A return line 73 from the valve 72 extends through an oil cooler 74 to the reservoir 63, the cooler being ventilated by a fan 76 driven by the motor 66. Also, in the line 73 there is a filter 77 returning to the reservoir 63. The filter is shunted by a bypass relief valve 78 should the filter become partly or entirely clogged.

The main valve 72 has two principal extreme positions. In an intermediate position, as shown, hydraulic liquid under pressure in the line 67 simply shunts through the valve into the line 73 and goes back to the reservoir 63 for continued recirculation. In one extreme or end position of the valve 72, for "up" position, the valve spool shifts to the right so that there is direct pressure oil flow from the line 67 into a conduit 81 extending to the second drive chamber 57. When the valve 72 is in this "up" position, a conduit 82 then connects the first drive chamber 56 through a special valve 83 to a line 84 and thence back through the main valve 72 to the conduit 73 and so to the reservoir 63. In this condition, the drive piston 52 is impelled toward the right in the figure or in the "up" direction as the chamber 56 contracts and discharges its contents through the lines 82 and 84 to the reservoir 63.

When the main valve 72 is shifted to the left into the opposite extreme position, the lines are in effect crossed. Pressure liquid from the conduit 67 flows into the conduit 84 and through the valve 83 and the conduit 82 to enlarge the first drive chamber 56. The drive piston 52 is moved leftward in the figure or in the "down" direction. Oil in the second drive chamber 57 flows therefrom through the conduit 81 and back through the main valve 72 and the line 73 to the reservoir 63. Thus, when the main valve 72 is moved into its opposite extreme positions, the drive piston 52 and its attendant structure is reciprocated in opposite directions. The result is that the flow piston 27 is correspondingly reciprocated and the main piston 21 is comparably traversed, as is the polish rod 8.

In order to operate the spool of the main valve 72 in an appropriate fashion, it is preferred to do so by a special, separate hydraulic circuit. For that reason, there is provided an auxiliary, relatively low pressure pump 86 driven by the same motor 66 and deriving its hydraulic fluid through a conduit 87 containing a filter 88 and opening into the reservoir 63 as a supply. The pump 86 discharges into a line 89 having a branch 91 passing through a pressure regulator valve 92 to maintain the pressure in the lines 89 and 91 at a desired value and having an overflow pipe 93 returning to the reservoir 63. The line 89 also continues to a connector C. For clarity in illustration, some conduits are omitted, but the connector C is joined to a connector C at the left, central portion of the figure and to a connector C at the right, central portion of the figure. From the connector C on the left side of the figure, the conduit 89 extends to the casing of a pilot valve 94 having two extreme positions and preferably being electrically moved into either one of such extreme positions by appropriate solenoids 95 and 100 and circuitry, not shown in complete detail.

In one extreme position of the pilot valve 94, as shown in the illustration, the auxiliary pressure liquid in the conduit 89 travels through the valve spool and through a conduit 96 into a hydraulic actuating chamber 97 for the main valve 72 and tends to move the main valve into its right-hand extreme or "up" position. Flow into the valve actuating chamber 97 through this path is not restricted in this direction by an adjustable orifice 98 in the line 96, because a check valve 99 in a shunt path around the orifice 98 opens in this direction. Flow in the opposite, outward direction is variably restricted by the adjustable valve 98 because the check valve 99 is then shut.

As the valve 72 moves to the right, flow is from another, similar, actuating chamber 101 when under pressure impelling the valve spool leftward. The flow now is outwardly through a restricted orifice 102 since a shunting check valve 103 is closed in this direction of flow. The flow continues through a conduit 104 back to the valve 94 and from there through a duct 106 to the reservoir 63.

When the solenoid-actuated valve 94 is reversed in position or occupies its other extreme position, then the hydraulic circuit is crossed and the pressure liquid from the conduit 89 is directed through the conduit 104 and through the orifice 102 and the then-open check valve 103 into the actuating chamber 101. The effect is to shift the spool of the valve 72 into its opposite or left extreme position. Corresponding outflow from the chamber 97 is primarily through the restricted orifice 98 since the check valve 99 is closed in this direction of operation. The valve 72 shifts position slowly as adjusted or regulated by the orifice 98. Flow continues outwardly through the line 96 and then crosses into the conduit 106 and back to the reservoir 63. In this fashion, and depending upon the actuation of the solenoids to shift the pilot valve 94, the main valve 72 is hydraulically shifted between its two extreme positions at controlled rates and thus assures that the piston 52 is moved in its "up" direction of in its "down" direction under careful reversing control.

While under circumstances in which the load is not high and the speed of reversal is not very great it is satisfactory simply to shift between an "up" motion of the pump and a "down" motion of the pump under relatively coarse valve shift control, nevertheless in instances when the load is relatively high and operation is relatively fast it is highly advisable to provide an arrangement in which the speed of the reciprocating masses is reduced slowly prior to reversal and then is accelerated slowly after reversal. The rate of slowing down and speeding up is preferably variable and in accordance with a satisfactory pattern.

For that reason, the special valve 83 included in the hydraulic lines 82 and 84 is especially characterized. The valve has the main function of restricting or limiting hydraulic flow in order to control piston acceleration (both negative and positive) or, in other words, acceleration and deceleration of the movement of the piston 52 and the attendant reciprocating members.

The valve 83 therefore, illustrated diagrammatically in FIG. 1, is a valve which has some predetermined throttling characteristics, depending upon its axial position. In shifting from a shut off or nearly shut off condition in one extreme (right-hand) position to an open condition in the other extreme (left-hand) position, there can be a variable flow control and a variable amount of throttling. To that end, the spool for the valve 83 is controlled or axially moved hydraulically through a pair of servo chambers 111 and 112. These chambers are similarly connected. The servo chamber 111, for example, is joined through a variable restrictor 113 and a shunt check valve 114, disposed in parallel, to a line 116 extending to a pilot valve 117. Similarly, the servo chamber 112 is connected through a variable restrictor 118 and a bypass check valve 119 in shunt therewith and a conductor 121 to the pilot valve 117.

Within the valve 117, the valve shuttle 122 is movable under the control of accelerating and decelerating solenoids 123 and 124 effective to snap the valve 117 between its two extreme positions. In the accelerating (or open) position shown, pressure fluid from the auxiliary pump 86 in the conduit 89, connected at C, is received in an extension of the conduit 89 at the valve 117. A release duct 126 extends from the valve 117 to the reservoir 63. With this arrangement and with the shuttle of the valve 117 in the position shown, pressure fluid from the conduit 89 flows through the line 116 and the check valve 114 freely (some going through the restrictor 113) to pressurize the chamber 111 to shift the servo valve 83 to its restricting position opposite that illustrated. When the accelerating solenoid 123 is deenergized and the decelerating solenoid 124 is effective, the pilot valve 117 shifts to the left in FIG. 1 and then the spool of the valve 83 is shifted back to the positive shown in FIG. 1 and pressure fluid from the line 89 goes into the line 121, thence through the check valve 119 (and the restrictor 118 in part) and pressurizes the chamber 112 so that the valve spool 83 shifts fo the other, free flowing extreme position. Since the restrictors 113 and 118 can be adjusted to suit, the speed of shifting of the spool for the valve 83 can be controlled in each direction. Perhaps more important, the configuration of the valve spool in the valve 83 is of a special shape or of a particular characteristic. This is indicated by the converging lines in the drawing symbol. The rate of flow in each incremental, shifted position of the valve 83 is selectable at will or is predetermined by such special shape. The rates of acceleration and deceleration are thus controlled to a desired profile.

In order appropriately to time the actuation of the solenoids 123 and 124 in appropriate positions of the reciprocating masses, various different techniques can be employed, but for illustration herein there is employed a mechanical arrangement. The piston rod 51 is extended through the cylinder head 54, leaving the chambers 56 and 57 of the same net area, and also is provided at its extremity with a cam bar 131 having inclined ends.

Figure 3:
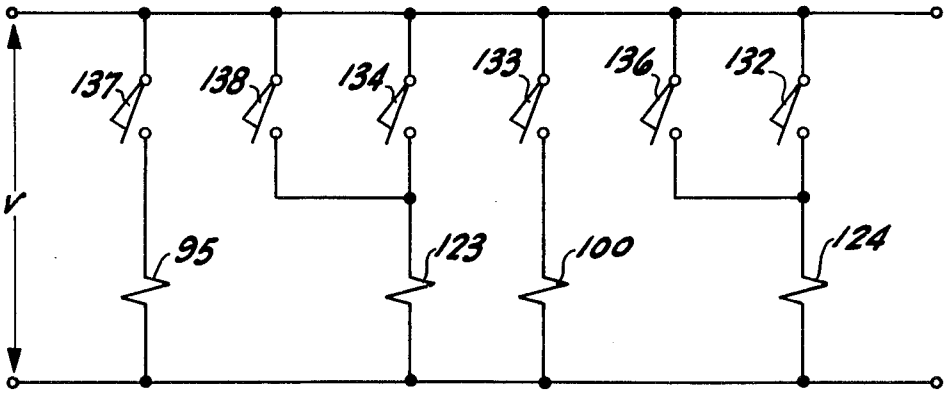
FIG. 3 is a schematic diagram of some electric switch circuitry.

Arrayed in the path of the cam bar 131 is a series of switches 132, 133 and 134 near one end of the stroke and another series of switches 136, 137 and 138 near the other end of the stroke. These are electrical limit switches wired as shown in the diagram of FIG. 3 and effective to control the solenoids 95 and 100 of the valve 94, as well as the solenoids 123 and 124 of the valve 117. As the cam 131 moves toward the right end of its stroke, for example, on the "up" stroke of the pistons 21 and 51, the cam 131 first encounters and actuates the switch 132 connected to the solenoid 123. This shifts into or holds the valve 117 in the straight position shown and puts through the line 116 the valve 83 in a throttling or decelerating position. Oil flow in the lines 82 and 84 is thus substantially restricted. The piston 52, consequently, in approaching the upper end of its stroke is gradually slowed down. At the end of the "up" stroke, the cam 131 actuates the switch 133. This is a reversing or "down" switch effective to energize the solenoid 100 and to shift the pilot valve 94 and thus to reverse the spool of the valve 72 and change the flow to urge the piston 52 downwardly or to the left in the figure.

The effect of the reversing valve 72 is relatively slow, because of the restrictions 98 and 102, so that before the piston rod 51 actually comes to the upper (right-hand) end of its movement, the cam 131 actuates the switch 134. This energizes the solenoid 124 to shift the servo valve 117 into cross section. This, in turn through the line 121 operates the valve 83 to reopen gradually and allow increasing, accelerating flow through the conduits 82 and 84 to accelerate the piston 52 in the downward direction. By proper adjustment of the restrictors 98 and 102, as well as the restrictors 113 and 118, it is possible gradually to decelerate the piston 52 toward the latter part of its "up" stroke, reverse the piston at the top of its "up" stroke and accelerate the piston at the beginning of its next "down" stroke.

In a similar fashion, near the end of the "down" stroke, the cam 131 first encounters and actuates the switch 136 energizing the solenoid 123 to shift the servo valve 117 into straight position to reclose the decelerating valve 83. Then the cam 131 operates the switch 137, the solenoid 95, the reversing servo valve 94 and the reversing valve 72 itself, but before the piston 52 actually stops its downward motion, the cam 131 travels to and actuates the switch 138, the solenoid 124, moving the valve 117 into crossed position and energizing the servo chamber 112 to move the accelerating valve 83 back to open position. Thus, the piston slows, reverses and accelerates upwardly again.

In this fashion, the mechanism automatically slows down near one end of the stroke, changes the direction of stroke, and then speeds up and finally travels uniformly to a point near the other end of the stroke, at which again its slows down, then changes its direction and then finally speeds up to the uniform rate at which it returns to the point of starting. The groups of switches 132, 133 and 134, as well as 136, 137 and 138, can be positioned along the path of the cam 131 at any desired locations. In this way the stroke of the piston 52 and its related reciprocating parts and of the polish rod 8 can be set at any desired length. Furthermore, the stroke, if less than maximum, can occupy any selected traverse in the range. Also, the individual switches in each group can be positioned as desired with respect to the cam 131, so that each event can begin at any selected location. In this way, the pumping unit can easily be set up for any particular well or succession of wells and can be varied in operating stroke and characteristics from time to time.

With these careful and precise liquid and force controls, and with the pneumatic counterbalancing, the pumping jack or pump actuator operates with a relatively small amount of fluid pumped by the main pump 61 and by utilizing the effective areas of the intensifier comprised of the pistons 27 and 52 and their local hydraulic circuits.

Figure 2:
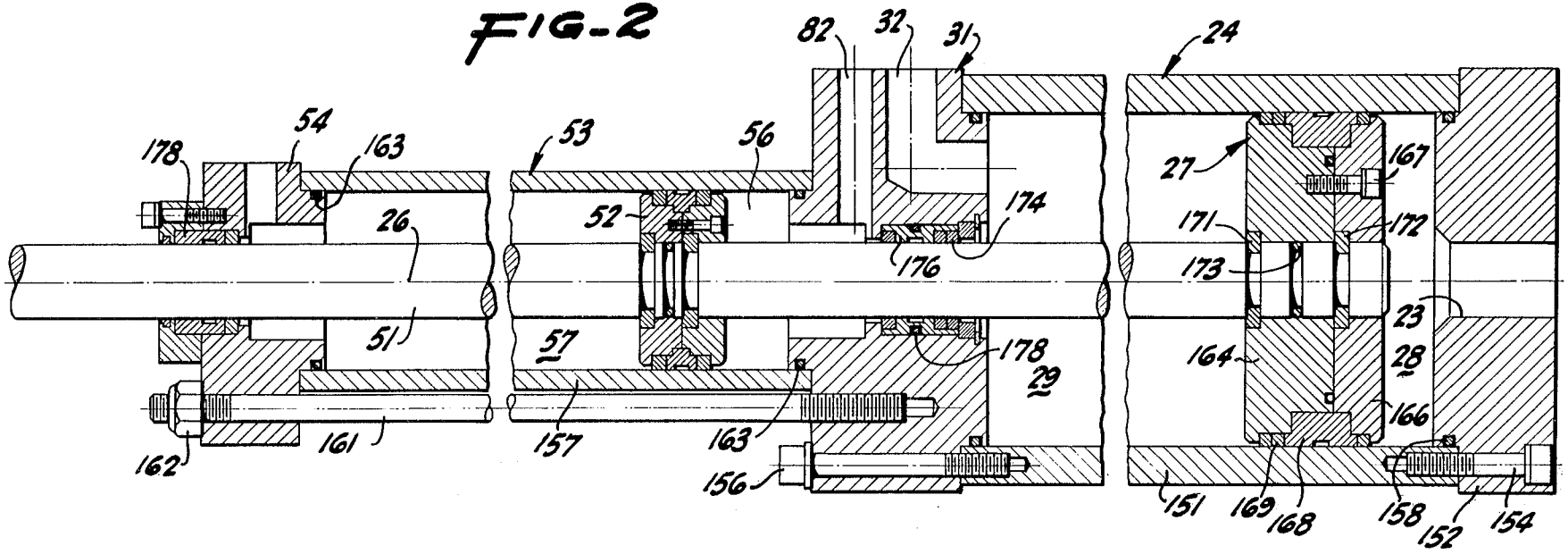
FIG. 2 is a cross-section on an axial plane through an intensifier or drive pump and flow pump shown representationally, with certain portions being broken away to reduce the size of the figure and certain portions being rotated out of actual position for clearer illustration.

In the intensifier, as shown in actual detail in FIG. 2, the construction is especially arranged for long-life linear action. The flow chambers 28 and 29 are preferably formed in a single tube 151 having a head 152 through which the conduit 23 extends. The head 152 is secured in position by cap screws 154, and similar connectors 156 are utilized to hold the intermediate cylinder head 31 in position, there being sealing rings 158 between each of the heads and the cylinder tube 151.

The head 31 in a similar fashion receives a tube 157 forming the drive cylinder 53 provided with its own closure head 54, the entire assembly being secured by a number of tie rods 161 threaded into the head 31 and having their own nuts 162. Appropriate packing or sealing rings 163 are utilized at the opposite ends of the cylinder tube 157. The piston rod 51 within the cylinder 24 carries the piston 27, preferably fabricated of a number of discs 164 and 166 secured together by fastenings 167 and in effect clamping a wear ring 168 and accompanying piston rings 169 in position. The piston discs are positioned and mounted by place rings 171 and 172 and are provided with seal rings 173. The piston rod 51 in going through the cylinder head 31 also traverses sealing rings 174 and a wear ring 176. The drive piston 52 is a composite construction very much like the flow piston 27, and there is in the head 54 a packing 178 comparable to the packing 174. With this mechanical construction, the mechanism is effective to operate over a very long period and under relatively steady, heavy loads but with a relatively small circulation of propelling oil so that the energy involved in pumping the well 7 is relatively low. The shock of reciprocating mechanism is relatively low also because of the reversing, accelerating and decelerating features.

We claim:

1. A pumping unit for a well pump comprising a main cylinder, a main piston reciprocable in said cylinder, means for connecting said piston to said well pump, a flow cylinder having a predetermined diameter, a flow piston reciprocable in said flow cylinder and dividing said flow cylinder into a first flow chamber and a second flow chamber, means for connecting said first flow chamber to said main cylinder, means for supplying air under pressure to said second flow chamber, a drive cylinder, a drive piston reciprocable in said drive cylinder and dividing said drive cylinder into a first drive chamber and a second drive chamber, means for interconnecting said flow piston and said drive piston, a source of liquid under relatively high pressure, a sink for liquid under relatively low pressure, a reversing valve movable between two positions, means including ducts effective in one of said positions for connecting said source to said first drive chamber and said sink to said second drive chamber and in the other of said positions for connecting said sink to said first drive chamber and said source to said second drive chamber, a throttling valve in one of said ducts and movable between a first position restricting flow in said one duct and a second position unrestricting flow in said one duct, and means responsive to the position of said drive piston for moving said reversing valve between said two positions and for moving said throttling valve between said first position and said second position.

2. A device as in claim 1 in which the diameter of said flow cylinder is substantially larger than the diameter of said drive cylinder.

3. A device as in claim 1 in which the stroke of said flow cylinder is substantially smaller than the stroke of said main cylinder.

4. A device as in claim 1 in which said air supplied to said second flow chamber is supplied at a pressure substantially to counterbalance load in said means for connecting said piston to said well pump.

5. A device as in claim 1 in which said means for moving said reversing valve is settable to be effective at selected positions in the stroke of said drive piston.

6. A device as in claim 1 including means for moving said throttling valve into said first position immediately before and immediately after said reversing valve moves between said two positions.

* * * * *